US007484632B2

(12) United States Patent
Hytönen

(10) Patent No.: US 7,484,632 B2
(45) Date of Patent: Feb. 3, 2009

(54) METHOD FOR CONTROLLING A CRANE

(75) Inventor: Kimmo Hytönen, Hyvinkää (FI)

(73) Assignee: KCI Konecranes PLC, Hyvinkaa (FI)

( * ) Notice: Subject to any disclaimer, the term of this patent is extended or adjusted under 35 U.S.C. 154(b) by 179 days.

(21) Appl. No.: 10/564,553

(22) PCT Filed: Jul. 16, 2004

(86) PCT No.: PCT/FI2004/000457

§ 371 (c)(1),
(2), (4) Date: Jan. 13, 2006

(87) PCT Pub. No.: WO2005/007553

PCT Pub. Date: Jan. 27, 2005

(65) Prior Publication Data

US 2006/0175276 A1 Aug. 10, 2006

(30) Foreign Application Priority Data

Jul. 17, 2003 (FI) ..... 20031086

(51) Int. Cl.
*B66C 13/06* (2006.01)

(52) U.S. Cl. ..... 212/270; 212/275

(58) Field of Classification Search ..... 212/270, 212/275

See application file for complete search history.

(56) References Cited

U.S. PATENT DOCUMENTS

| | | | | |
|---|---|---|---|---|
| 3,921,818 | A | 11/1975 | Yamagishi | |
| 5,529,193 | A * | 6/1996 | Hytonen | 212/275 |
| 5,806,695 | A | 9/1998 | Hytonen | |
| 6,050,429 | A | 4/2000 | Habisohn | |
| 6,102,221 | A | 8/2000 | Habisohn | |

FOREIGN PATENT DOCUMENTS

| | | | |
|---|---|---|---|
| FI | 89155 | B | 5/1993 |
| WO | WO-92/18416 | A1 | 10/1992 |

* cited by examiner

*Primary Examiner*—Thomas J. Brahan
(74) *Attorney, Agent, or Firm*—Muncy, Geissler, Olds & Lowe PLLC

(57) ABSTRACT

The invention relates to a method for controlling a crane, the method comprising defining, at each time, the distance (s) the crane moves before stopping and without swinging of the load fastened to it by summing up a stopping distance ($s_1$), which is calculated on the basis of the internal target velocity, i.e. the velocity which the control of the algorithm implementing this has after the stored velocity changes are entirely implemented, by using the selected deceleration ramp; and a distance ($s_2$), which is calculated on the basis of stored velocity change requests stated before the stopping decision and on the basis of remaining performance times.

3 Claims, 3 Drawing Sheets

METHOD FOR CONTROLLING A CRANE

BACKGROUND OF THE INVENTION

The invention relates to a method for controlling a crane, the method comprising giving velocity requests as control sequences from a crane control system to crane drives and reading and storing the velocity requests in a control system, whereby each velocity request is compared with the previous velocity request and, if the velocity request is changed, an acceleration sequence for the corresponding velocity change is formed and stored, after which, irrespective of whether the velocity request has changed, summing the velocity changes defined by the stored acceleration sequences at a given time and adding the obtained sum to the previous velocity request to achieve a new velocity request, which is set as a new control and velocity request for the crane drives, and performing some of the velocity changes defined by the summed acceleration sequences at the definition time of each sequence and performing the rest of them as delayed.

The above method is disclosed in Finnish Patent 89155. By using this method it is possible to efficiently prevent the undesired swinging of load fastened to the crane, disturbing the use and operability of the crane when the crane is controlled and the load is transferred. The method improves the properties of a crane control system by summing, in a particular manner, different control sequences eliminating the swinging occurring after load acceleration. By using this method, the end velocities forming the target of acceleration can be randomly changed at any time, also during the actual velocity change sequences, and a new, desired end velocity is achieved without undesired swinging of the load.

According to prior art, a control preventing the load swinging typically comprises two acceleration sequences, the time difference of which is half of the oscillation time of the load. Another, easily definable control consists of three acceleration sequences with the same magnitude but varying directions, the first sequence being positive, the second negative and the third positive, whereby the time between the sequences equals to one sixth of the oscillation time of the load. In the method of Finnish Patent 89155, these control sequences preventing the load swinging can differ from each other and an unlimited amount of them can be defined. It is essential that when the accelerations defined by them are summed up, a control preventing the swinging is achieved. When the sum of the accelerations is selected in such a manner that it implements the desired velocity change, a control is achieved, wherein the desired end velocity of the crane is produced without swinging of the load.

U.S. Pat. No. 5,526,946 discloses an application of the same subject, whereby, whenever the reference value of velocity changes, a half of it is performed and the other half is stored in a table, where the performance of it is delayed by a half of the oscillation time of the load. This is a preferred embodiment of the method according to Finnish Patent 89155 and used in computer calculation.

Methods preventing the end swinging of the crane load by adapting acceleration and deceleration ramps cause problems when the stopping distance of the crane is estimated. When the crane is accelerated, it is difficult to estimate where it will stop at each time, if the velocity request is set as zero. This complicates the programming of the operation when the load is positioned automatically and when the operations take place near the limits of the allowable movement range of the crane.

In addition, when the lifting height of the crane load is changed, also the oscillation time of the load and the distance the crane travels before stopping change. When the crane is accelerated and the majority of the velocity control of the crane is stored in tables and will be carried out as delayed, it is difficult to estimate the stopping distance of the crane. This is particularly problematic when the pendulum arm of the load is long, e.g. dozens of meters, and the load is transferred in a narrow, deep space.

SUMMARY OF THE INVENTION

It is an object of the present invention to eliminate these drawbacks by providing a method by which the stopping distance required by the crane can be calculated as accurately as possible.

The object is achieved by a method of the invention, mainly characterized by defining, at each time, the distance the crane moves before stopping and without swinging of the load fastened to it by summing up the following calculations:

a) Stopping distance, which is calculated on the basis of the internal target velocity, i.e. the velocity which the control of the algorithm implementing this has after the stored velocity changes are entirely implemented, by using the selected deceleration ramp, and b) Distance, which is calculated on the basis of stored velocity change stated before the stopping decision and on the basis of remaining performance times.

When decelerating the target velocity of point a), the distance caused by preventing the load from swinging, calculated on the basis of the part of the velocity control that differs from the deceleration ramp and being travelled by the crane when the swinging of the load caused by the actual deceleration ramp is damped with this differing velocity control is preferably added to the calculation result.

The storages are preferably placed in a two-element table, whereby the velocity change which is to be carried out after a certain oscillation time is stored in the first element and the time, after which the velocity change or changes of the first element are carried out, is stored in the second element.

A deceleration ramp can be any predefined ramp, e.g. a linear or S-curve ramp.

The invention is based on the fact that the distance travelled is the velocity integrated with regard to time. When a velocity graph is drafted, the parts used for calculating the total velocity can be defined separately and the integral thereof can be calculated with regard to time.

A considerable advantage of the method of the invention is that the allowable movement range of the crane can be entirely utilized and that the acceleration or deceleration can always take place in a desired manner without having to worry whether, as a result of a swinging movement, the load hits the walls of a bunker-like space, because the invention allows that, at each time, the stopping distance required by the crane without load swinging can be calculated with a very high accuracy.

LIST OF FIGURES

The invention will now be described in greater detail with reference to the attached drawings, in which FIG. 1 schematically shows a crane;

FIGS. 4*a* to 4*e* graphically illustrate the crane control and the calculation of the stopping distance of the crane according to the invention.

DETAILED DESCRIPTION OF THE INVENTION

The method of the invention is illustrated in connection with a simple overhead crane 1 of FIG. 1, even though any other crane, where the load to be lifted can oscillate, is also possible.

Figure 1:
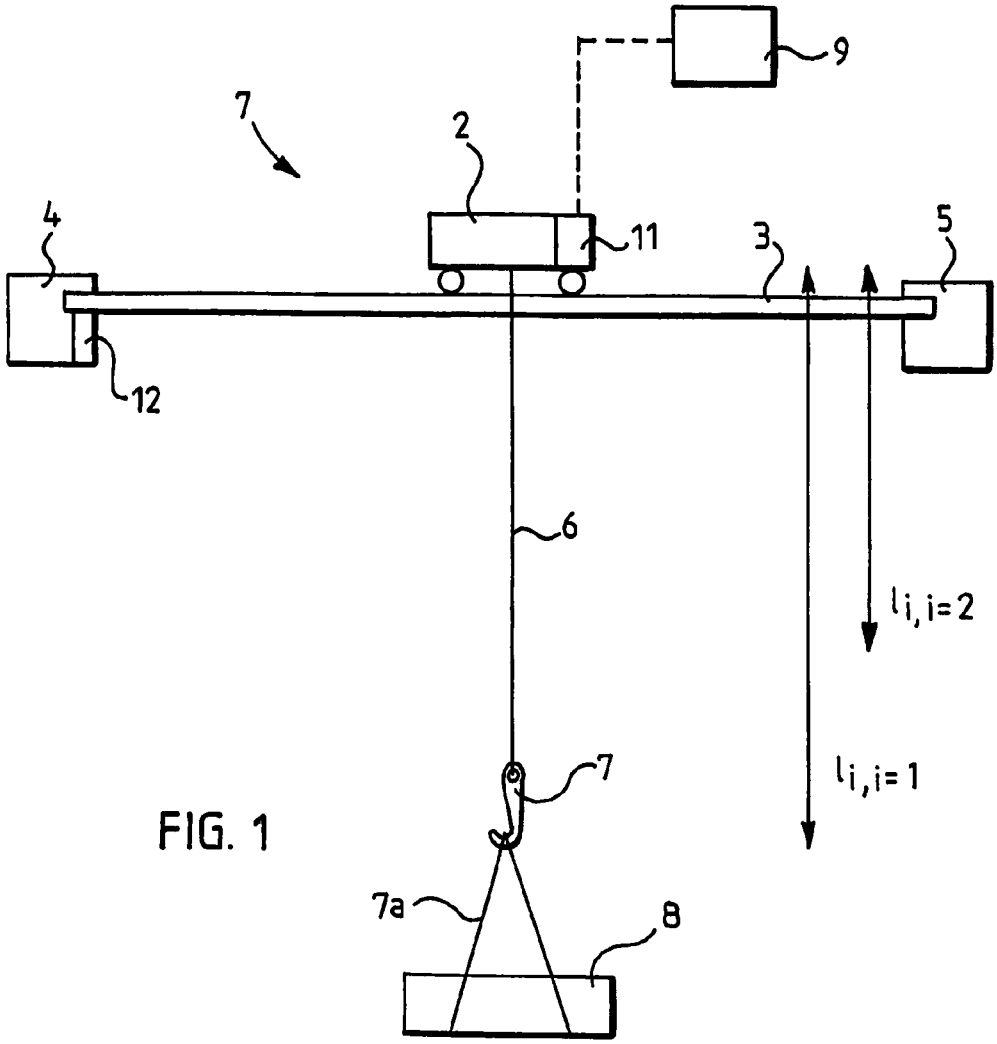

A trolley 2 of the overhead crane 1 according to FIG. 1 is arranged to be moved along a bridge beam 3, which can be moved along end beams 4 and 5 arranged at the ends of the bridge beam 3 perpendicularly to the movement of the trolley 2. A lifting rope 6, at the end of which there is a lifting element 7, in this case a lifting hook, hangs from the trolley 2. A load 8 to be lifted is fastened by means of lifting belts 7*a* to the lifting hook 7. Each different lifting height $l_i$ (i=1, 2, . . . ) has a characteristic oscillation time T of the lifting height $l_i$, whereby the oscillation time of the load 8 is obtained by the formula:

$$T=2\pi(l_i/g)^{1/2}, \text{ where g=acceleration of gravity.}$$

Figure 2:
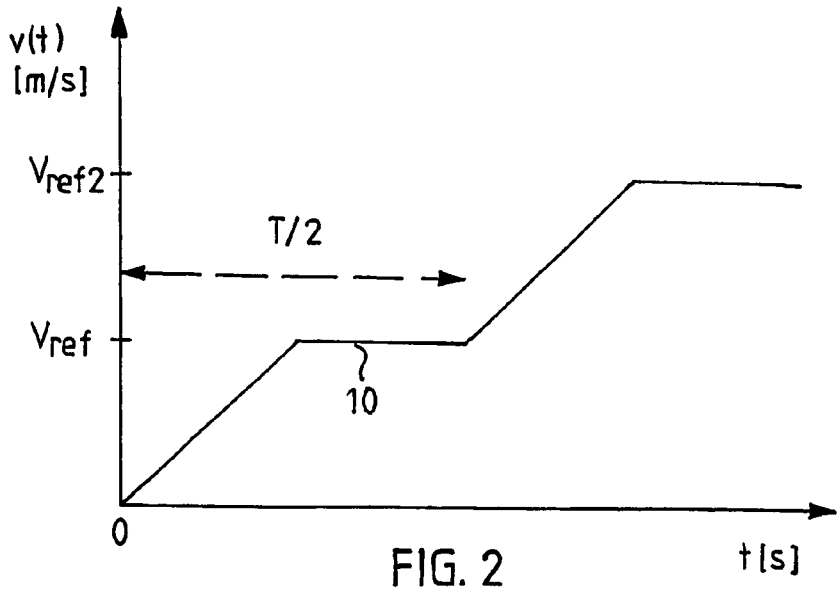
FIG. 2 shows a velocity sequence acting as a control sequence.

The crane 1 is controlled with a crane control system 9 by means of different control sequences 10, one simple example of which is shown in FIG. 2. A control sequence 10 of FIG. 2 is a velocity vector v(t), which is shown as a function of time t. The control sequence 10 is directed to control a drive 11 of the trolley 2 or a drive 12 of the bridge beam 3 supporting the trolley 2. Drives are typically electric motor drives with frequency converters.

Figure 3:
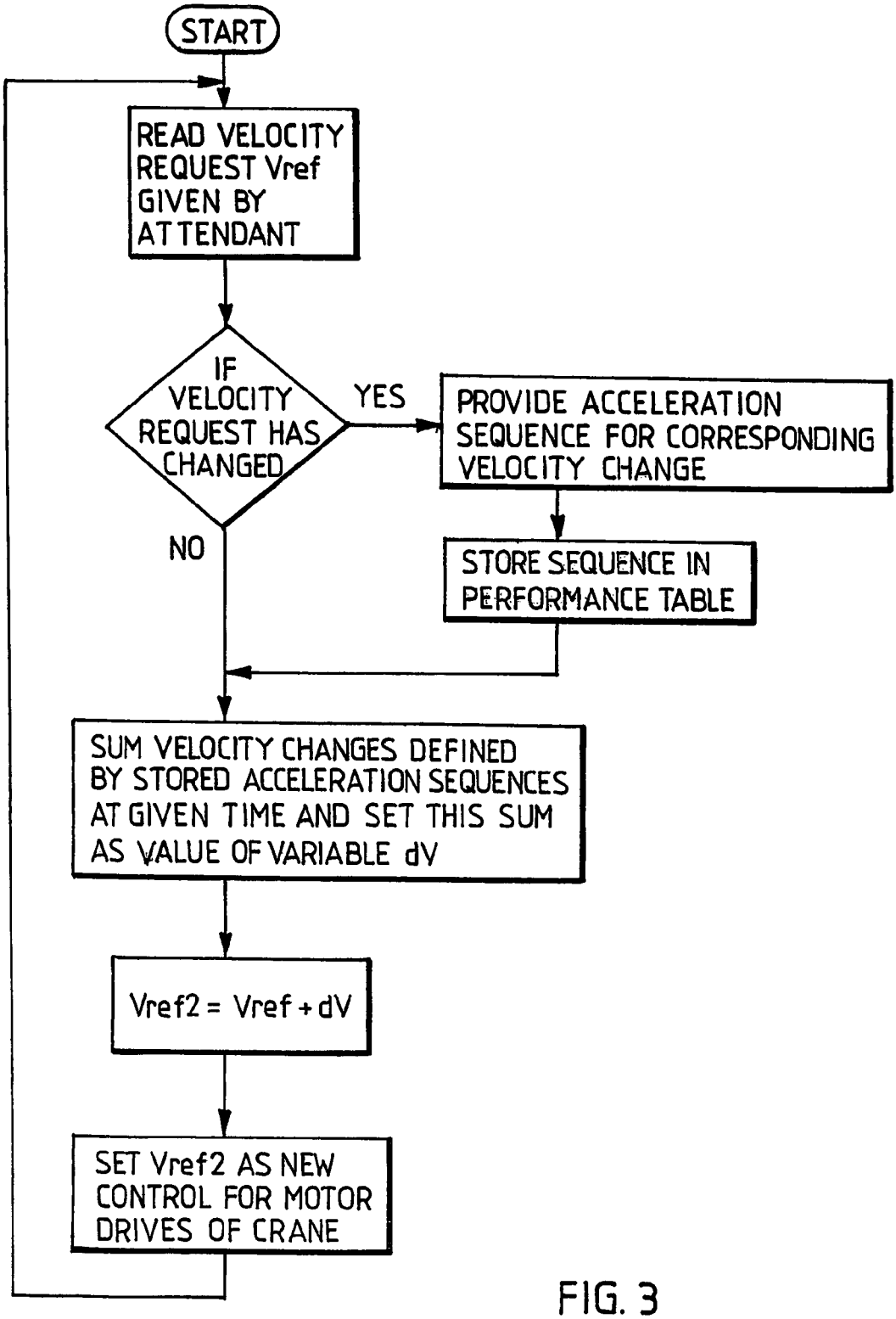
FIG. 3 shows a flow chart of a crane control.

FIG. 3 shows a flow chart illustrating a method for controlling a crane and forming a basis for the invention. The user of the crane 1 gives, from the control system 9, velocity requests $V_{ref}$ as control sequences 10 to drives 11, 12 of the crane 1. The velocity requests $V_{ref}$ are read and stored in the control system 9, after which each velocity request $V_{ref}$ is compared with the previous velocity request and, if the velocity request $V_{ref}$ is changed, an acceleration sequence (either with a plus or a minus sign) for a corresponding velocity change is formed and stored, after which, irrespective of whether the velocity request $V_{ref}$ changes, the velocity changes defined by the stored acceleration sequences at a given time are summed and the obtained sum dV is added to the previous velocity request $V_{ref}$ to achieve a new velocity request $V_{ref2}$, which is set as a new control and velocity request $V_{ref2}$ for the crane drives. Some of the velocity changes defined by the summed acceleration sequences are performed at the definition time of each sequence and the rest of them are performed as delayed. The above-described method is described in greater detail in Finnish Patent 89155, and the details thereof, such as the summing of velocity or acceleration sequences known per se, are thus not described in more detail, but a reference is made, for instance, to the patent mentioned above.

To describe the method of the invention used for calculating the stopping distance of the crane 1, an example is given, wherein a crane 1 control is formed in such a manner that a velocity sequence v(t) is formed at each control step of the crane 1 control (a period according to FIG. 3), the velocity sequence implementing autonomously a series of velocity changes, each of which can be carried out during one control step, and the used sequence is formed of two acceleration pulses, the time between the pulses being half of the oscillation time T of the load 8. Such a sequence is generally known. At the time of forming a sequence, a first part of the sequence is formed and a second part is stored in a performance table (not shown in the drawings) for instance as two figures, the first of which represents time, after which the delayed sequence is performed, and the second of which represents the magnitude of the part of the delayed sequence.

The time after which the changes are performed is expressed as a figure and defined in such a manner that $T_{SP}$, for instance, represents the complete oscillation period of the load 8. Whenever an element of the table is processed, a figure $T_{step}$, representing the past time, is obtained from the formula:

$$T_{step}=T_{step}+D/T*T_{SP},$$

where D=control step (sample interval), and

T=the above-described oscillation time of the load 8

When a new sequence is stored in the table, the part of the table representing the past time $T_{step}$ is set to zero. Whenever tables are gone through, a figure calculated with the above formula and describing the time which has passed during the control period D in respect of the complete oscillation time T of the load 8 is added to the line of the table describing past time $T_{step}$. When the value of the element reaches the figure which represents the part of the complete oscillation period $T_{SP}$ by which the stored velocity change is to be delayed, this velocity control is carried out and these elements of the table are set to zero.

The tables described above thus include the magnitude and duration of the stored velocity changes. The duration can be scaled for each lifting height (i.e. oscillation time T) of the load 8 by dividing the time remaining before the performance time by the figure $T_{SP}$ and by multiplying by the current oscillation time. The distance $s_1$, which the crane 1 would travel before stopping, can be calculated on the basis of the internal target velocity. If a linear deceleration ramp is used, the distance is obtained by the formula:

$$s_1=v*t_{dec}/2, \text{ where v=velocity and } t_{dec}\text{=deceleration time.}$$

On the basis of the velocity changes stored in the tables, it is possible to calculate the distance $$s_2=\Sigma(\text{the remaining time before performance*velocity change to be carried out}).$$

If a two-pulse control is used, the additional distance $s_3$ caused by oscillation damping can be calculated with the formula:

$$s_3=v/2*T/2,$$

since the control is carried out in two parts, the latter of which is delayed by the half of the oscillation time T.

Total distance s, after which the crane 1 stops, is obtained by adding all the above distances together, i.e.:

$$s=s_1+s_2+s_3.$$

Figure 4A:
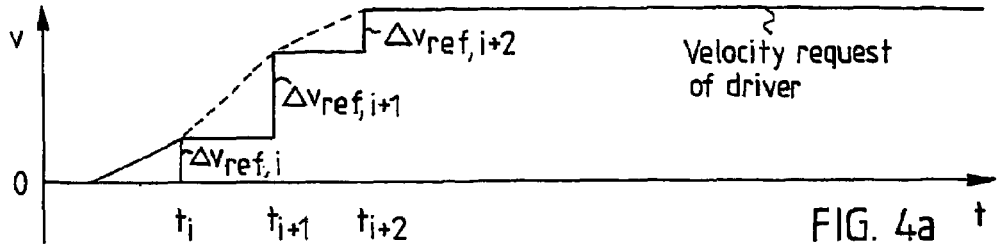
Figure 4B:
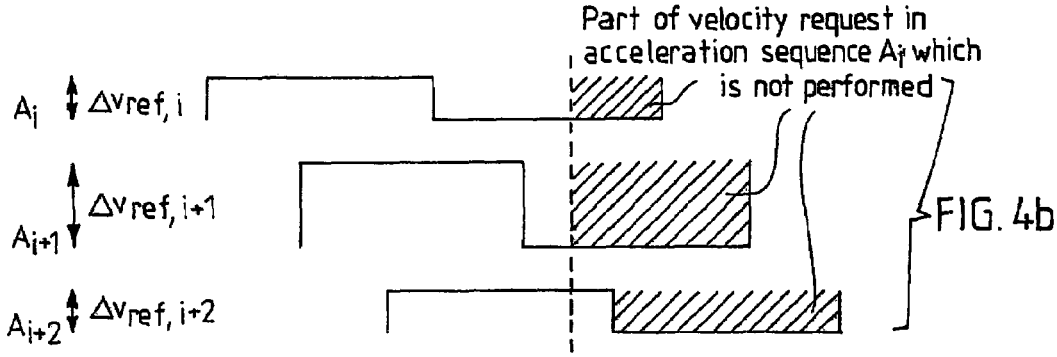

FIG. 4*a* shows a change of the velocity request of the driver as a function of time. At sample intervals $t_i$, $t_{i+1}$, . . . , velocity request changes are measured with respect to the previous measurement.

$$\Delta v_{ref,i}=v_{ref,i}-v_{ref,i-1} \text{ (FIG. 4}a\text{)}$$

Figure 4C:
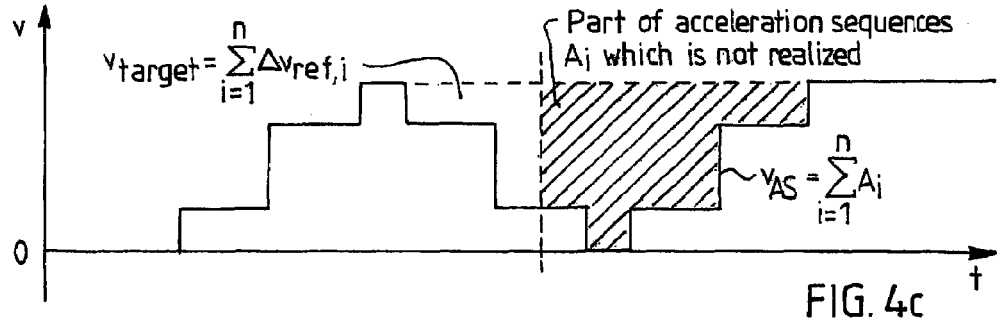
Figure 4D:
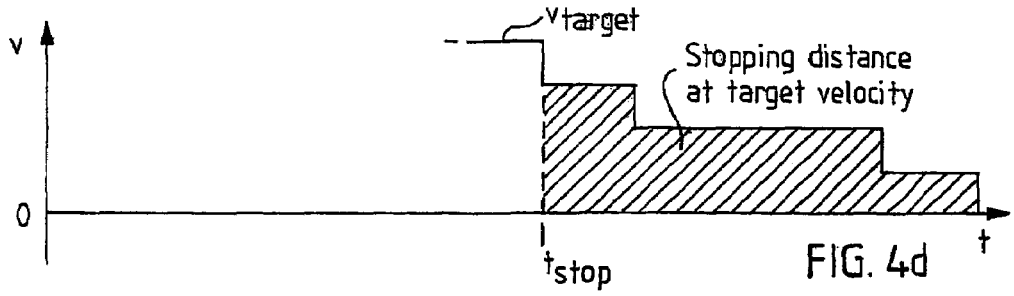

If the velocity request has changed (FIG. 4*b*), a corresponding acceleration sequence $A_i$ is formed. The velocity request of the crane $V_{AS}$ is formed by summing the acceleration sequences A (FIG. 4*c*).

$$v_{AS}=\sum_{i=1}^{n} A_i$$

The target velocity, i.e. the velocity the crane has when all stored acceleration sequences $A_i$ have been performed, is $$v_{target} = \sum_{i=1}^{n} \Delta v_{ref,i}$$

The distance the crane travels before stopping at the moment $t_{stop}$ can be defined by calculating the distance the crane would travel, if it were stopped at the target velocity $v_{target}$ of that time by using the selected deceleration manner. In this example, a strategy of two deceleration periods is used.

Figure 4E:
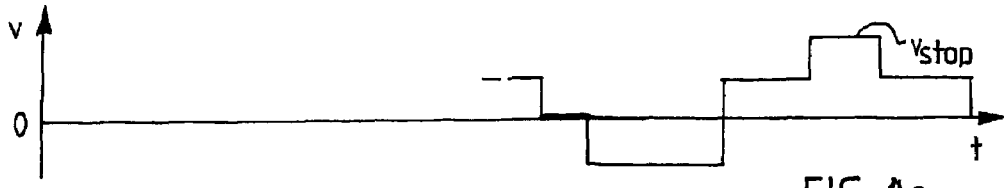

At the moment $t_{stop}$, however, some of the stored acceleration sequences $A_i$ are not yet performed. The deceleration velocity request of the crane, which is to be realized, is shown in FIG. 4*e*.

This velocity graph to be realized is formed by summing the accelerations of the deceleration ramp according to the selected strategy and the non-realized accelerations pulses of the current acceleration sequences $A_1$, when the initial velocity is $v_{AS}$ at the moment $t_{stop}$.

The distance the crane travels before stopping can be calculated by subtracting the velocity controls of the acceleration sequences $A_i$, not realized at the moment $t_{stop}$ (FIG. 4*c*) and forming a part of the stopping distance of the crane implemented with a selected acceleration strategy, from the velocity $v_{target}$ at the moment $t_{stop}$.

Acceleration should be understood herein both as positive and negative, in other words as acceleration in its literal sense and as an opposite deceleration effect.

Although the above method describes the distance the crane travels before stopping in a clear manner, the result of it must often be corrected in the practice, since the velocity of traversing motors of a crane does not totally correspond to the ideal velocity control, delays occur in the calculations as well as in the calculation of the crane location, on the basis of which the positioning is usually carried out. In addition, the load can be lifted or lowered during deceleration. In practical applications, these factors must be compensated for by different corrections, which are calculated on the basis of the crane velocity, load velocity and oscillation time.

The invention claimed is:

1. A method for calculating a distance in which a crane is stopped, the method comprising:

giving velocity requests as control sequences from a crane control system to crane drives and reading and storing the velocity requests (Vref) in a control system, each velocity request (Vref) is compared with the previous velocity request and, if the velocity request is changed, an acceleration sequence for the corresponding velocity change is formed and stored, after which, summing the velocity changes defined by stored acceleration sequences after a given time interval and adding the obtained sum (dV) to the previous velocity request to achieve a new velocity request (Vref2), which is set as a new control and velocity request for the crane drives, and performing some of the velocity changes defined by the summed acceleration sequences at a definition time of each acceleration sequence and performing the rest of them as delayed, defining, at any given time, a distance (s) the crane moves before stopping and without swinging of the load fastened to it by summing up the following calculations:

a) stopping distance (s1), which is calculated on the basis of, a velocity at which the control of an algorithm implementing this ends, when the stored velocity changes are entirely implemented, by using a selected deceleration ramp, and b) a second distance (s2), which is calculated on the basis of stored velocity change requests stated before a stopping decision, and on the basis of remaining performance times.

2. A method as claimed in claim 1, wherein when decelerating a target velocity of point a), a third distance (s3) caused by preventing the load from swinging, calculated on the basis of the part of the velocity control that differs from the deceleration ramp and being travelled by the crane when the swinging of the load caused by the actual deceleration ramp is damped with this differing velocity control is added to the calculation result.

3. A method as claimed in claim 1, further comprising placing the stored velocity changes in a two-element table, whereby the velocity change which is to be carried out after a certain oscillation time is stored in the first element and the time, after which the velocity change or changes of the first element are carried out, is stored in the second element.

* * * * *